US007937006B2

(12) United States Patent
Takeuchi

(10) Patent No.: US 7,937,006 B2
(45) Date of Patent: May 3, 2011

(54) IMAGE FORMING APPARATUS WITH IMPROVED PRESSURE CONTROL

(75) Inventor: Naoki Takeuchi, Osaka (JP)

(73) Assignee: Kyocera Mita Corporation (JP)

( * ) Notice: Subject to any disclaimer, the term of this patent is extended or adjusted under 35 U.S.C. 154(b) by 401 days.

(21) Appl. No.: 12/203,710

(22) Filed: Sep. 3, 2008

(65) Prior Publication Data

US 2009/0060541 A1 Mar. 5, 2009

(30) Foreign Application Priority Data

Sep. 4, 2007 (JP) ..... 2007-228952

(51) Int. Cl.
*G03G 15/20* (2006.01)

(52) U.S. Cl. ..... 399/45; 399/67

(58) Field of Classification Search ..... 399/45, 399/67, 328, 68
See application file for complete search history.

(56) References Cited

U.S. PATENT DOCUMENTS

| | | | | |
|---|---|---|---|---|
| 7,512,372 | B2 * | 3/2009 | Burton et al. | 399/331 |
| 2005/0196186 | A1 * | 9/2005 | Suzuki | 399/45 |
| 2007/0025750 | A1 * | 2/2007 | Ando | 399/67 |

FOREIGN PATENT DOCUMENTS

| | | | |
|---|---|---|---|
| JP | 02132481 | A * | 5/1990 |
| JP | 05119664 | A * | 5/1993 |
| JP | 2004-279702 | | 7/2004 |

* cited by examiner

*Primary Examiner* — Quana M Grainger
(74) *Attorney, Agent, or Firm* — Stephen M. Chin; von Simson & Chin LLP

(57) ABSTRACT

An image forming apparatus according to an aspect of the present invention includes a fixing/pressurizing roller pair that nips a transfer sheet and transports to fix toner on the transfer sheet; a pressure control unit that controls a pressure demonstrated by the fixing/pressurizing roller pair in consideration of the type of the transfer sheet; a transfer sheet compatibility determining unit that determines whether or not the pressure set by the pressure control unit is compatible with the transfer sheet to be inserted between the fixing/pressurizing roller pair; and a control unit that performs a process to cause to notify a user of incompatibility and/or a process to forbid printing if the transfer sheet compatibility determining unit determines that the pressure set by the pressure control unit is not compatible with the transfer sheet.

6 Claims, 2 Drawing Sheets

IMAGE FORMING APPARATUS WITH IMPROVED PRESSURE CONTROL

CROSS-REFERENCE TO RELATED APPLICATIONS

This application relates to and claims priority rights from Japanese Patent Application No. 2007-228952, filed on Sep. 4, 2007, the entire disclosure of which is hereby incorporated by reference herein.

BACKGROUND OF THE INVENTION

1. Field of the Invention

This invention relates to image forming apparatus.

2. Description of the Related Art

In an image forming apparatus, when printing on an envelope, if an envelop is transported through a fixing part under the same condition for plain paper, then image quality may decline due to a crease of the envelope, due to that toner comes off the envelope, etc.

A method is proposed to solve the aforementioned problem. In the method, according to the type of a sheet, pressure switching mechanism switches between a normal mode and an envelope mode with changing pushing force per unit area (i.e. pressure) to a heating roller demonstrated by first and second pressure rollers in order to prevent creasing the sheet (See Japanese Laid-Open Patent Application 2004-279702).

SUMMARY OF THE INVENTION

However, in this method, error printing may take place when a current pressure mode is not compatible with a printing sheet used for printing.

For instance, in an image forming apparatus capable of operating in a normal mode for printing on plain paper and in an envelope mode for printing on an envelope to prevent creasing the envelope with lowering a pressure by a fixing/pressurizing roller pair in a fixing part, if a current set mode is not a mode compatible with a printing sheet used for printing, error printing takes place.

This invention has been made in view of the aforementioned circumstances. It is an object of this invention to provide an image forming apparatus capable of preventing error printing.

The present invention solves this subject as follows.

An image forming apparatus according to an aspect of the present invention includes a fixing/pressurizing roller pair that nips a transfer sheet and transports to fix toner on the transfer sheet; a pressure control unit that controls a pressure demonstrated by the fixing/pressurizing roller pair in consideration of the type of the transfer sheet; a transfer sheet compatibility determining unit that determines whether or not the pressure set by the pressure control unit is compatible with the transfer sheet to be inserted between the fixing/pressurizing roller pair; and a control unit that performs a process to cause to notify a user of incompatibility and/or a process to forbid printing if the transfer sheet compatibility determining unit determines that the pressure set by the pressure control unit is not compatible with the transfer sheet.

According to this, it is possible to prevent error printing due to incompatibility between a pressure set in a pressure control unit and a pressure required to a transfer sheet.

An image forming apparatus according to an aspect of the present invention includes a fixing/pressurizing roller pair that nips a transfer sheet and transports to fix toner on the transfer sheet; a pressure control unit that controls a pressure demonstrated by the fixing/pressurizing roller pair in consideration of the type of the transfer sheet; a transfer sheet compatibility determining unit that determines whether or not the pressure set by the pressure control unit is compatible with the transfer sheet to be inserted between the fixing/pressurizing roller pair; and a speed control unit that changes a transportation speed demonstrated by the fixing/pressurizing roller pair to a speed compatible with the type of the transfer sheet if the transfer sheet compatibility determining unit determines that the pressure set by the pressure control unit is not compatible with the transfer sheet.

According to this, it is possible to prevent error printing, for instance, by lowering a transportation speed of plain paper in a fixing part under a low-pressure condition set for an envelope.

These and other objects, features and advantages of the present invention will become more apparent upon reading of the following detailed description along with the accompanied drawings.

DETAILED DESCRIPTION OF THE PREFERRED EMBODIMENT

Figure 1:
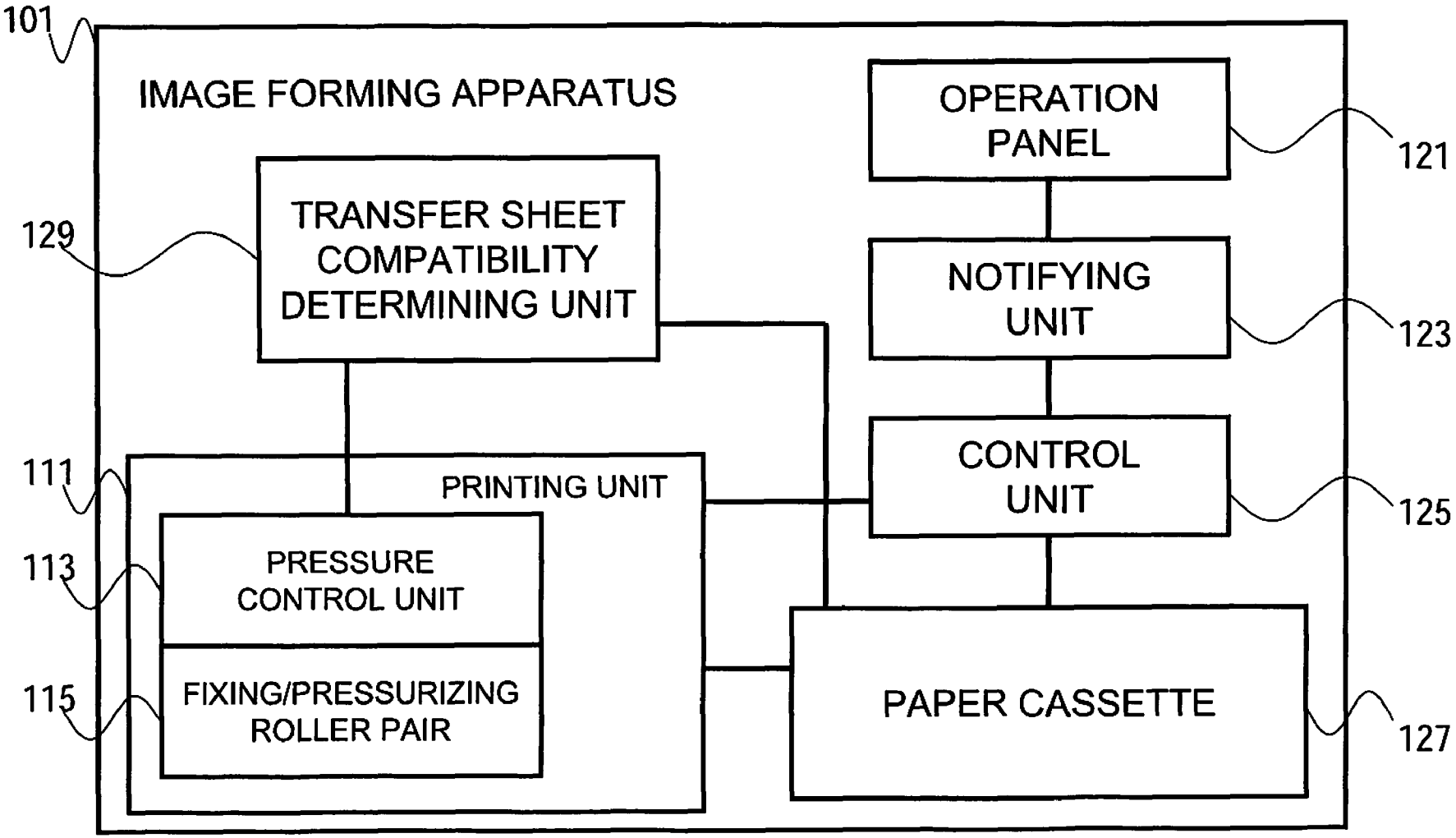
FIG. 1 shows a functional block diagram of an image forming apparatus according to an embodiment of the present invention.

FIG. 1 shows a functional block diagram of an image forming apparatus according to an embodiment of the present invention.

An image forming apparatus 101 contains a printing unit 111, a pressure control unit 113, a fixing/pressurizing roller pair 115, an operation panel 121, a notifying unit 123, a control unit 125, a paper cassette 127, and a transfer sheet compatibility determining unit 129.

The printing unit 111 receives a printing sheet supplied from the paper cassette 127 and performs printing on the sheet according to control by the control unit 125.

The pressure control unit 113 controls a pressure demonstrated by the fixing/pressurizing roller pair 115. The pressure demonstrated by the roller pair 115 is variable. The pressure control unit 113 sets either a high pressure in a normal mode for plain paper, super thick paper and an OHP sheet or a low pressure in an envelope mode for an envelope.

The fixing/pressurizing roller pair 115 is a roller pair that thermally fixes toner that has been transferred on a printing sheet. The roller pair 115 nips the printing sheet on therebetween, and transports the sheet in terms of rotation of the rollers, and then cause to thermally fix the toner on the transfer sheet (i.e. the printing sheet that the toner has been transferred on) in terms of heat of a heating roller.

The operation panel 121 contains operation buttons and a display panel for user operations to the image forming apparatus 101. The operation panel 121 detects user operations for causing the image forming apparatus 101 to perform copier operation, scanner operation and so on, and for setting the type of the transfer sheet put in the paper cassette 127.

The notifying unit 123 performs a process to notify a user of incompatibility if the transfer sheet compatibility determining unit 129 determines that the pressure mode set by the pressure control unit 113 is not compatible with the transfer sheet. In order to notify, an error message is displayed on the operation panel 121. In case that a user operates the apparatus 101 from a terminal device, the incompatibility is notified to the terminal device and an error message is displayed in the terminal device.

The control unit 125 performs either a process to forbid printing in the printing unit 111 or a process to lower a line speed demonstrated by the fixing/pressurizing roller pair 115 if the transfer sheet compatibility determining unit 129 determines that the pressure set by the pressure control unit 113 is not compatible with the transfer sheet. Operations of the control unit 125 in some cases will be explained below with reference to Table 1. The control unit 125 may act as a speed control unit, and the notifying unit 123 may be included in the control unit 125.

The paper cassette 127 stores printing sheets such as plain paper or OHP sheet, and supplies the sheets to the printing unit 111. Relationships between the paper cassette and the type of the printing sheets in the paper cassette such as plain paper or OHP sheet is determined and saved by user operations to the operation panel 121.

The transfer sheet compatibility determining unit 129 determines whether or not the pressure mode (i.e. the normal mode or the envelope mode) set by the pressure control unit 113 is compatible with the type of the transfer sheet set in terms of user operation input to the operation panel 121.

Figure 2:
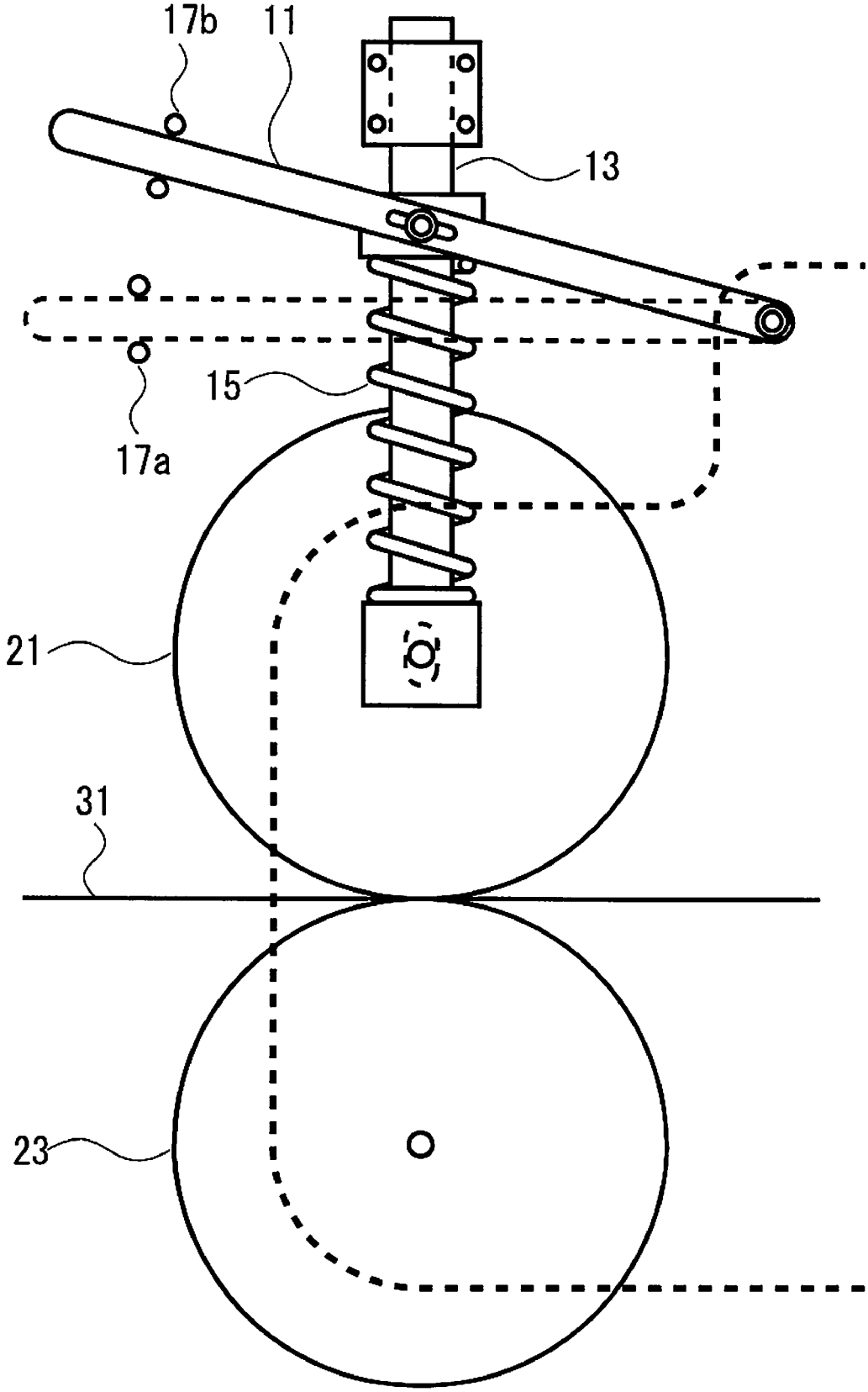
FIG. 2 shows a side view of a fixing part in an image forming apparatus according to an embodiment of the present invention.

An instance of structure of the fixing/pressurizing roller pair 115 and the pressure control unit 113 is explained next. FIG. 2 shows a side view of a fixing part in the image forming apparatus 101. The fixing part contains a pressure control lever 11, a pressure roller supporting shaft 13, a pressure roller urging spring 15, projection pairs 17*a* and 17*b*, a pressure roller 21, and a heating roller 23.
The transfer sheet 31 is nipped between the pressure roller 21 and the heating roller 23.

In FIG. 2, the pressure control unit 113 consists of the pressure control lever 11, the pressure roller supporting shaft 13, and the pressure roller urging spring 15. In FIG. 2, the fixing/pressurizing roller pair 115 consists of the pressure roller 21 in the upper side and the heating roller 23 in the lower side.

The center shaft of the pressure roller 21 is supported by an end (the lower end) of the pressure roller supporting shaft 13 as rotatable and as slidable in up and down direction (i.e. parallel to the shaft 13) within a restricted range. The pressure roller urging spring 15 is placed around the pressure roller supporting shaft 13. An end (the upper end) of the pressure roller urging spring 15 is supported by the pressure control lever 11, and the other end (the lower end) of the pressure roller urging spring 15 is supported by the end (the lower end) of the pressure roller supporting shaft 13. Therefore, the pressure roller 21 obtains a pressure by stability of the pressure roller urging spring 15. In addition, the pressure of the roller 21 is changed according to the position of the lever 11.

The heating roller 23 is placed in a position opposite to the pressure roller 21, and the center shaft of the roller 23 is supported as rotatable. A heat source is placed inside the heating roller 23, and the surface of the heating roller 23 is heated when electric power is supplied to the heat source, and consequently, the toner is fixed on the transfer sheet 31 contacting with the surface of the heating roller 23.

The upper end of the pressure roller urging spring 15 is supported by the intermediate part of the pressure control lever 11. The pressure control lever 11 is rotatable about an end (the right end) of the lever 11, and according to the position of the lever 11, the spring length of the pressure roller urging spring 15 is changed and the stability of the spring 15 is changed. As shown in FIG. 2 when the lever 11 is placed in the position of the normal mode, drawn with broken lines, the pressure of the roller pair 115 is high, and when the lever 11 is placed in the position of the envelope mode, drawn with solid lines, the pressure of the roller pair 115 is low.

When the pressure control lever 11 is set in the normal mode and the envelope mode, the projection pair 17*a* and 17*b* rest the lever 11, respectively. The projection pairs 17*a* and 17*b* act as pressure control lever position detecting sensors and supporting projections for supporting the lever 11. The transfer sheet compatibility determining unit 129 receives a signal transmitted from the sensors in the projection pairs 17*a* and 17*b*, and according to the signal, determines which of the normal mode and the envelope mode the pressure control lever 11 is set in.

Operations of the image forming apparatus 101 in the normal mode and the envelope mode are explained next.

Table 1 shows how the control unit 125 controls the printing unit 111 under each of combinations between the type of the transfer sheet 31 (here, any of plain paper, super thick paper, OHP sheet and envelope) and the status of the lever 11 of the pressure control unit 113.

TABLE 1

| | LEVER STATUS | |
|---|---|---|
| MEDIA TYPE | NORMAL MODE | ENVELOPE MODE |
| MEDIA#1 (PLAIN PAPER ETC.) | NORMAL OPERATION | LOW SPEED OPERATION |
| MEDIA#2 (SUPER THICK PAPER ETC.) | NORMAL OPERATION | ERROR STOP |
| MEDIA#3 (OHP SHEET ETC.) | NORMAL OPERATION | ERROR STOP |
| ENVELOPE | ERROR STOP | NORMAL OPERATION |

When the pressure control lever 11 is set in the normal mode and the transfer sheet 31 is any of plain paper, super thick paper and an OHP sheet, the setting is correct, therefore the control unit 125 causes the printing unit 111 to operate normally. When in the normal mode the transfer sheet 31 is an envelope, a crease would take place due to high pressure, and therefore the notifying unit 123 causes the operation panel 121 etc. to display an error message to notify an error and the control unit 125 forbids printing in the printing unit 111.

When the pressure control lever 11 is set in the envelope mode and the transfer sheet 31 is an envelope, the setting is correct, therefore the control unit 125 causes the printing unit 111 to operate normally. When in the envelope mode the transfer sheet 31 is any of plain paper, super thick paper and an OHP sheet, fixing process would not be performed normally due to low pressure, and therefore the notifying unit 123 causes the operation panel 121 etc. to display an error message to notify an error and the control unit 125 forbids printing in the printing unit 111.

When in the envelope mode the transfer sheet 31 is plain paper, it is possible to heat enough to fix toner thermally if the line speed is lowered in the fixing part even though the pressure is low, and therefore the control unit 125 lowers the rotation speed of the roller pair 115 (i.e. the line speed) and causes the printing unit 111 to perform printing.

The image forming apparatus 101 according to the embodiment of the present invention offers advantages as follows.

It is possible to prevent error printing due to incompatibility between the setting of the lever 11 and the type of the transfer sheet.

Further, even if the lever 11 is set in the envelope mode, it is possible to perform printing by lowering the line speed of the roller pair 115 without stopping printing operation.

Specifically, in an image forming apparatus capable of operating in a normal mode for printing on plain paper and in an envelope mode for printing on an envelope to prevent creasing the envelope with lowering a pressure by a fixing/pressurizing roller pair in a fixing part, even if incompatibility between the mode and the sheet takes place, error printing can be prevented with stopping operation or lowering the line speed.

The description of the present invention has been presented for purposes of illustration and description, and is not intended to be exhaustive or limited to the invention in the form disclosed. Many modifications and variations will be apparent to those of ordinary skill in the art.

In the fixing/pressurizing roller pair 115, toner may be not only fixed thermally by a heater as mentioned in this embodiment, but also fixed in terms of pressure.

The printing sheet may be a transfer sheet such as plain paper, thick paper, envelope or OHP sheet.

In this embodiment, the pressure control lever 11 is moved manually. Alternatively, the pressure control lever 11 may be moved mechanically by a driving unit such as solenoid, and the pressure control lever 11 may be moved to the position in the correct mode by the driving unit when incompatibility between the mode and the sheet takes place.

In this embodiment, the fixing/pressurizing roller pair 115 consists of two rollers. Alternatively, the fixing/pressurizing roller pair 115 may consist of three or more rollers. Further, alternatively, one roller in the fixing/pressurizing roller pair 115 may be changed to a belt.

In this embodiment, the type of the printing sheet is input on the operation panel 121 by a user. Alternatively, one or more sensors may be placed in the image forming apparatus in order to detect the type of the transfer sheet 31.

What is claimed is:

1. An image forming apparatus comprising:

a fixing/pressurizing roller pair that nips a transfer sheet and transports to fix toner on the transfer sheet;

a pressure control unit that controls a pressure demonstrated by the fixing/pressurizing roller pair in consideration of the type of the transfer sheet;

a transfer sheet compatibility determining unit that determines whether or not the pressure set by the pressure control unit is compatible with the transfer sheet to be inserted between the fixing/pressurizing roller pair; and a control unit that performs a process to cause to notify a user of incompatibility and/or a process to forbid printing if the transfer sheet compatibility determining unit determines that the pressure set by the pressure control unit is not compatible with the transfer sheet, wherein the pressure control unit changes the pressure to a pressure compatible with the transfer sheet if the transfer sheet compatibility determining unit determines that the pressure set by the pressure control unit is not compatible with the transfer sheet.

2. An image forming apparatus comprising:

a fixing/pressurizing roller pair that nips a transfer sheet and transports to fix toner on the transfer sheet;

a pressure control unit that controls a pressure demonstrated by the fixing/pressurizing roller pair in consideration of the type of the transfer sheet;

a transfer sheet compatibility determining unit that determines whether or not the pressure set by the pressure control unit is compatible with the transfer sheet to be inserted between the fixing/pressurizing roller pair; and a speed control unit that changes a transportation speed demonstrated by the fixing/pressurizing roller pair to a speed compatible with the type of the transfer sheet if the transfer sheet compatibility determining unit determines that the pressure set by the pressure control unit is not compatible with the transfer sheet, wherein the pressure control unit that operates either in a normal mode for the transfer sheet of plain paper or in an envelope mode to lower the pressure for the transfer sheet of an envelope, and the speed control unit lowers the transportation speed demonstrated by the fixing/pressurizing roller pair if the transfer sheet compatibility determining unit determines that the pressure control unit operates in the envelope mode when the transfer sheet is plain paper.

3. An image forming apparatus comprising:

a fixing/pressurizing roller pair that nips a transfer sheet and transports to fix toner on the transfer sheet;

a pressure control unit that controls a pressure demonstrated by the fixing/pressurizing roller pair in consideration of the type of the transfer sheet;

a transfer sheet compatibility determining unit that determines whether or not the Pressure set by the pressure control unit is compatible with the transfer sheet to be inserted between the fixing/pressurizing roller pair; and a speed control unit that changes a transportation speed demonstrated by the fixing/pressurizing roller pair to a speed compatible with the type of the transfer sheet if the transfer sheet compatibility determining unit determines that the pressure set by the pressure control unit is not compatible with the transfer sheet, further comprising a control unit that performs a process to cause to notify a user of incompatibility and/or a process to forbid printing if the transfer sheet compatibility determining unit determines that the pressure set by the pressure control unit is not compatible with the transfer sheet.

4. The image forming apparatus according to claim 2, wherein the pressure control unit changes the pressure to a pressure compatible with the transfer sheet if the transfer sheet compatibility determining unit determines that the pressure set by the pressure control unit is not compatible with the transfer sheet.

5. The image forming apparatus according to claim 3, wherein the pressure control unit changes the pressure to a pressure compatible with the transfer sheet if the transfer sheet compatibility determining unit determines that the pressure set by the pressure control unit is not compatible with the transfer sheet.

6. The image forming apparatus according to claim 3, wherein the pressure control unit changes the pressure to a pressure compatible with the transfer sheet if the transfer sheet compatibility determining unit determines that the pressure set by the pressure control unit is not compatible with the transfer sheet.

* * * * *